US008974609B2

(12) United States Patent
Ogawa et al.

(10) Patent No.: US 8,974,609 B2
(45) **Date of Patent: *Mar. 10, 2015**

(54) FERROMAGNETIC AMORPHOUS ALLOY RIBBON AND FABRICATION THEREOF

(75) Inventors: Yuichi Ogawa, Myrtle Beach, SC (US); Eric A. Theisen, Myrtle Beach, SC (US); Yuji Matsumoto, Tottori (JP); James Perrozi, Myrtle Beach, SC (US); Ryusuke Hasegawa, Morristown, NJ (US)

(73) Assignees: Metglas, Inc., Conway, SC (US); Hitachi Metals, Ltd., Tokyo (JP)

( * ) Notice: Subject to any disclaimer, the term of this patent is extended or adjusted under 35 U.S.C. 154(b) by 382 days.

This patent is subject to a terminal disclaimer.

(21) Appl. No.: 12/923,074

(22) Filed: Aug. 31, 2010

(65) Prior Publication Data

US 2012/0048428 A1 Mar. 1, 2012

(51) Int. Cl.

| | |
|---|---|
| ***H01F 27/25*** | (2006.01) |
| ***B22D 11/00*** | (2006.01) |
| ***H01F 1/153*** | (2006.01) |
| ***B22D 11/06*** | (2006.01) |
| ***H01F 41/02*** | (2006.01) |

(52) U.S. Cl.

CPC ..... *B22D 11/0611* (2013.01); *H01F 1/15308* (2013.01); *H01F 1/15333* (2013.01); *H01F 41/0226* (2013.01)

USPC ..... 148/304; 336/213; 164/462

(58) Field of Classification Search

USPC ..... 148/100, 300, 104

See application file for complete search history.

(56) References Cited

U.S. PATENT DOCUMENTS

| | | | | |
|---|---|---|---|---|
| 4,264,882 | A | 4/1981 | Tsuya et al. | |
| 4,768,458 | A * | 9/1988 | Arakawa et al. | 164/463 |
| 5,332,455 | A | 7/1994 | Chang et al. | |
| 5,741,373 | A | 4/1998 | Suzuki et al. | |
| 6,273,967 | B1 * | 8/2001 | Matsuki et al. | 148/304 |

(Continued)

FOREIGN PATENT DOCUMENTS

| | | |
|---|---|---|
| JP | 61-24208 | 2/1986 |
| JP | 11-302823 | 11/1999 |

OTHER PUBLICATIONS

Lim et al., Magnetic Properties of Amorphous Alloy Strips Fabricated by Planar Flow Casting (PFC), Journal of Physics, 144, 2009.*

(Continued)

*Primary Examiner* — Roy King
*Assistant Examiner* — Xiaowei Su

(57) ABSTRACT

A ferromagnetic amorphous alloy ribbon includes an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities, the defect length along a direction of the ribbon's length being between 5 mm and 200 mm, the defect depth being less than 0.4×t μm and the defect occurrence frequency being less than 0.05×w times within 1.5 m of ribbon length, where t and w are ribbon thickness and ribbon width, respectively, and the ribbon in its annealed state and straight strip form of the ribbon, has a saturation magnetic induction exceeding 1.60 T, and exhibits a magnetic core loss of less than 0.14 W/kg when measured at 60 Hz and at 1.3 T induction level. The ribbon is suitable for use in transformer cores, rotational machines, electrical chokes, magnetic sensors and pulse power devices.

21 Claims, 4 Drawing Sheets

(56) References Cited

U.S. PATENT DOCUMENTS

| | | | | |
|---|---|---|---|---|
| 6,425,960 | B1 * | 7/2002 | Yoshizawa et al. | 148/300 |
| 7,425,239 | B2 | 9/2008 | Ogawa et al. | |
| 7,988,798 | B2 * | 8/2011 | Ozaki et al. | 148/304 |
| 2006/0000524 | A1 * | 1/2006 | Ogawa et al. | 148/304 |
| 2006/0000525 | A1 | 1/2006 | Naoe et al. | |
| 2006/0191602 | A1 * | 8/2006 | Hasegawa et al. | 148/304 |
| 2009/0065100 | A1 * | 3/2009 | Yoshizawa et al. | 148/305 |
| 2009/0145524 | A1 * | 6/2009 | Ogawa et al. | 148/304 |
| 2010/0163136 | A1 * | 7/2010 | Ozaki et al. | 148/304 |

OTHER PUBLICATIONS

International Search Report and Written Opinion of the International Searching Authority mailed Jan. 12, 2012 issued in corresponding International Patent Application No. PCT/US11/49698.

International Preliminary Report on Patentability mailed Sep. 11, 2012 in corresponding International Patent Application No. PCT/US11/49698.

Office Action mailed Sep. 3, 2013 in U.S. Appl. No. 12/923,076.

Office Action mailed Sep. 12, 2013 in U.S. Appl. No. 12/923,224.

U.S. Appl. No. 12/923,076, filed Aug. 31, 2010, Azuma et al., Metglas, Inc. and Hitachi Metals, Ltd.

U.S. Appl. No. 12/923,224, Sep. 9, 2010, Theisen et al., Metglas, Inc. and Hitachi Metals, Ltd.

Taiwanese Office Action for related Taiwanese Patent Application No. 100131134, issued on Jan. 23, 2014.

Taiwanese Office Action for related Taiwanese Patent Application No. 100131136, mailed on Jan. 23, 2014.

Japanese Office Action dated Aug. 1, 2014 in corresponding Japanese Patent Application No. 2013-527186.

Japanese Office Action dated Aug. 1, 2014 in related Japanese Patent Application No. 2013-527188.

U.S. Office Action dated Aug. 6, 2014 in related U.S. Appl. No. 12/923,076.

U.S. Office Action dated Jul. 30, 2014 in related U.S. Appl. No. 12/923,224.

* cited by examiner

Ribbon Length Direction

FERROMAGNETIC AMORPHOUS ALLOY RIBBON AND FABRICATION THEREOF

BACKGROUND

1. Field

The present invention relates to a ferromagnetic amorphous alloy ribbon for use in transformer cores, rotational machines, electrical chokes, magnetic sensors and pulse power devices and a method of fabrication of the ribbon.

2. Description of Related Art

Iron-based amorphous alloy ribbon exhibits excellent soft magnetic properties including low magnetic loss under AC excitation, finding its application in energy efficient magnetic devices such as transformers, motors, generators, energy management devices including pulse power generators and magnetic sensors. In these devices, ferromagnetic materials with high saturation inductions and high thermal stability are preferred. Furthermore, the ease of the materials' manufacturability and their raw material costs are important factors in large scale industrial use. Amorphous Fe—B—Si based alloys meet these requirements. However, the saturation inductions of these amorphous alloys are lower than those of crystalline silicon steels conventionally used in devices such as transformers, resulting in somewhat larger sizes of the amorphous alloy-based devices. Thus efforts have been made to develop amorphous ferromagnetic alloys with higher saturation inductions. One approach is to increase the iron content in the Fe-based amorphous alloys. However, this is not straightforward as the alloys' thermal stability degrades as the Fe content increases. To mitigate this problem, elements such as Sn, S, C and P have been added. For example, U.S. Pat. No. 5,456,770 (the '770 patent) teaches amorphous Fe—Si—B—C—Sn alloys in which the addition of Sn increases alloys' formability and their saturation inductions. In U.S. Pat. No. 6,416,879 (the '879 patent), the addition of P in an amorphous Fe—Si—B—C—P system is taught to increase saturation inductions with increased Fe content. However, the addition of such elements as Sn, S and C in the Fe—Si—B-based amorphous alloys reduces the ductility of the cast ribbon rendering it difficult to fabricate a wide ribbon. Also, the addition of P in the Fe—Si—B—C-based alloys as taught in '879 patent results in loss of long-term thermal stability which in turn leads to increase of magnetic core loss by several tens of percentage within several years. Thus the amorphous alloys taught in the '770 and '879 patents have not been practically fabricated by casting from their molten states.

In addition to a high saturation induction needed in magnetic devices such as transformers, inductors and the like, a high B—H squareness ratio and low coercivity, $H_c$, are desirable with B and H being magnetic induction and exciting magnetic field, respectively. The reason for this is that such magnetic materials have high degree of magnetic softness, meaning ease of magnetization. This leads to low magnetic losses in the magnetic devices using these materials. Realizing these factors, the present inventors found that these required magnetic properties in addition to high ribbon-ductility were achieved by maintaining the C precipitation layer on ribbon surface at a certain thickness by selecting the ratio of Si:C at certain levels in an amorphous Fe—Si—B—C system as described in U.S. Pat. No. 7,425,239. Furthermore, in Japanese Kokai Patent No. 2009052064, a high saturation induction amorphous alloy ribbon is provided, which shows improved thermal stability of up to 150 years at 150° C. device operation by controlling the C precipitation layer height with addition of Cr and Mn into the alloy system.

However, the fabricated ribbon exhibited a number of surface defects such as scratches, face lines and split lines formed along the ribbon's length direction and on the ribbon surface facing the casting atmosphere-side which is opposite to the ribbon surface contacting the casting chill body surface. Examples of a split line and face lines are shown in FIG. 1. The basic arrangement of casting nozzle, chill body surface on a rotating wheel and resulting cast ribbon is illustrated in U.S. Pat. No. 4,142,571.

Thus, there is a need for a ferromagnetic amorphous alloy ribbon which exhibits a high saturation induction, a low magnetic core loss, a high B—H squareness ratio, high mechanical ductility, high long-term thermal stability, and reduced ribbon surface defects with high level of ribbon fabricability, which is the primary aspect of the present invention. More specifically, a thorough study of the cast ribbon surface quality during casting led to the following findings: the surface defects started in early stage of casting, and when the defect length along ribbon's length direction exceeded about 200 mm or defect depth exceeding about 40% of the ribbon thickness, the ribbon broke at the defect site, resulting in abrupt termination of casting. Because of this ribbon breakage, the rate of cast termination within 30 minutes after cast start-up amounted to about 20%. On the other hand, for the ribbon having saturation inductions of less than 1.6 T, the rate of cast termination within 30 minutes was about 3%. In addition, on these ribbons, defect length was less than 200 mm and defect depth was less than 40% of the ribbon thickness with defect incidence being one or two at every 1.5 m along ribbon's length direction. Thus, reduction of surface defects formed along ribbon's length direction in a ribbon with saturation inductions exceeding 1.6 T is clearly needed to achieve continuous casting, which is yet another aspect of the present invention.

SUMMARY

In accordance with aspects of the invention, a ferromagnetic amorphous alloy ribbon is based on an alloy having a composition represented by $Fe_aSi_bB_cC_d$ where $80.5 \le a \le 83$ at. %, $0.5 \le b \le 6$ at. %, $12 \le c \le 16.5$ at. %, $0.01 \le d \le 1$ at. % with $a+b+c+d=100$ and incidental impurities. The ribbon has a ribbon length, a ribbon thickness, a ribbon width, and a ribbon surface facing a casting atmosphere side. The ribbon has ribbon surface defects formed on the ribbon surface facing the casting atmosphere side, and the ribbon surface defects are measured in terms of a defect length, a defect depth, and a defect occurrence frequency. The defect length along a direction of the ribbon's length is between 5 mm and 200 mm, the defect depth is less than $0.4 \times t$ μm and the defect occurrence frequency is less than $0.05 \times w$ times within 1.5 m of ribbon length, where t and w are ribbon thickness and ribbon width, respectively. The ribbon, in its annealed state and straight strip form of the ribbon, has a saturation magnetic induction exceeding 1.60 T, and exhibits a magnetic core loss of less than 0.14 W/kg when measured at 60 Hz and at 1.3 T induction level.

According to one aspect of the invention, the ribbon has a composition in which the Si content b and the B content c are related to the Fe content a and the C content d according to relations of $b \ge 166.5 \times (100-d)/100-2a$ and $c \le a-66.5 \times (100-d)/100$.

According to another aspect of the invention, the ribbon is cast from a molten state of the alloy with a molten alloy surface tension exceeding and including 1.1 N/m.

According to an additional aspect of the present invention, the ribbon further includes a trace element of at least one of Cu, Mn and Cr to be favorable in reducing ribbon surface defects. In one option, the Cu content is between 0.005 and 0.20 wt. %. In another option, the Mn content may be between 0.05 and 0.30 wt. % and the Cr content is between 0.01 and 0.2 wt. %.

According to yet another aspect of the invention, in the ribbon, up to 20 at. % of Fe is optionally replaced by Co, and less than 10 at. % of Fe is optionally replaced by Ni, and the ribbon has reduced surface defects by controlling molten metal surface tension during casting.

According to yet an additional aspect of the invention, casting of the ribbon is performed at the melt temperature between 1,250° C. and 1,400° C. and the molten metal surface tension is in the range of 1.1N/m-1.6 N/m.

According to one more aspect of the invention, casting of the ribbon is performed in an environmental atmosphere containing less than 5 vol. % oxygen at the molten alloy-ribbon interface.

According to another aspect of the invention, a method of fabricating a ferromagnetic amorphous alloy ribbon includes selecting an alloy having a composition represented by $Fe_aSi_bB_cC_d$, where 80.5≤a≤83 at. %, 0.5≤b≤6 at. %, 12≤c≤16.5 at. %, 0.01≤d≤1 at. % with a+b+c+d=100 and incidental impurities; casting from a molten state of the alloy; and obtaining the ribbon. The cast ribbon has surface defects formed on the surface facing the casting atmosphere side. The defect length along a direction of the ribbon's length is between 5 mm and 200 mm, the defect depth is at less than 0.4×t μm and the defect occurrence frequency is less than 0.05×w times within 1.5 m of the ribbon length, where t is the ribbon thickness and w is the ribbon width. The ribbon, in an annealed state and straight strip form of the ribbon, has a saturation magnetic induction exceeding 1.60 T and exhibits a magnetic core loss of less than 0.14 W/kg when measured at 60 Hz and at 1.3 T induction level.

According to an additional aspect of the invention, an energy efficient device includes a ferromagnetic amorphous alloy ribbon, the ribbon being an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities, and the energy efficient device is a transformer, a rotational machine, an electric choke, a magnetic sensor or a pulse power device. The cast ribbon has surface defects formed on the surface facing the casting atmosphere side. The defect length along a direction of the ribbon's length is between 5 mm and 200 mm, the defect depth is at less than 0.4×t μm and the defect occurrence frequency is less than 0.05×w times within 1.5 m of the ribbon length, where t is the ribbon thickness and w is the ribbon width. The ribbon, in an annealed state and straight strip form of the ribbon, has a saturation magnetic induction exceeding 1.60 T and exhibits a magnetic core loss of less than 0.14 W/kg when measured at 60 Hz and at 1.3 T induction level.

According to one more aspect of the invention, a method of fabricating an energy efficient device includes selecting an alloy having a composition represented by $Fe_aSi_bB_cC_d$, where 80.5≤a≤83 at. %, 0.5≤b≤6 at. %, 12≤c≤16.5 at. %, 0.01≤d≤1 at. % with a+b+c+d=100 and incidental impurities; casting from a molten state of the alloy; and obtaining the ribbon, and incorporating the ribbon as part of an energy efficient device that can be a transformer, a rotational machine, an electric choke, a magnetic sensor or a pulse power device. The cast ribbon has surface defects formed on the surface facing the casting atmosphere side. The defect length along a direction of the ribbon's length is between 5 mm and 200 mm, the defect depth is at less than 0.4×t μm and the defect occurrence frequency is less than 0.05×w times within 1.5 m of the ribbon length, where t is the ribbon thickness and w is the ribbon width. The ribbon, in an annealed state and straight strip form of the ribbon, has a saturation magnetic induction exceeding 1.60 T and exhibits a magnetic core loss of less than 0.14 W/kg when measured at 60 Hz and at 1.3 T induction level.

BRIEF DESCRIPTION OF THE DRAWINGS

The invention will be more fully understood and further advantages will become apparent when reference is made to the following detailed description of the preferred embodiments and the accompanying drawings in which.

DETAILED DESCRIPTION

Figure 1:
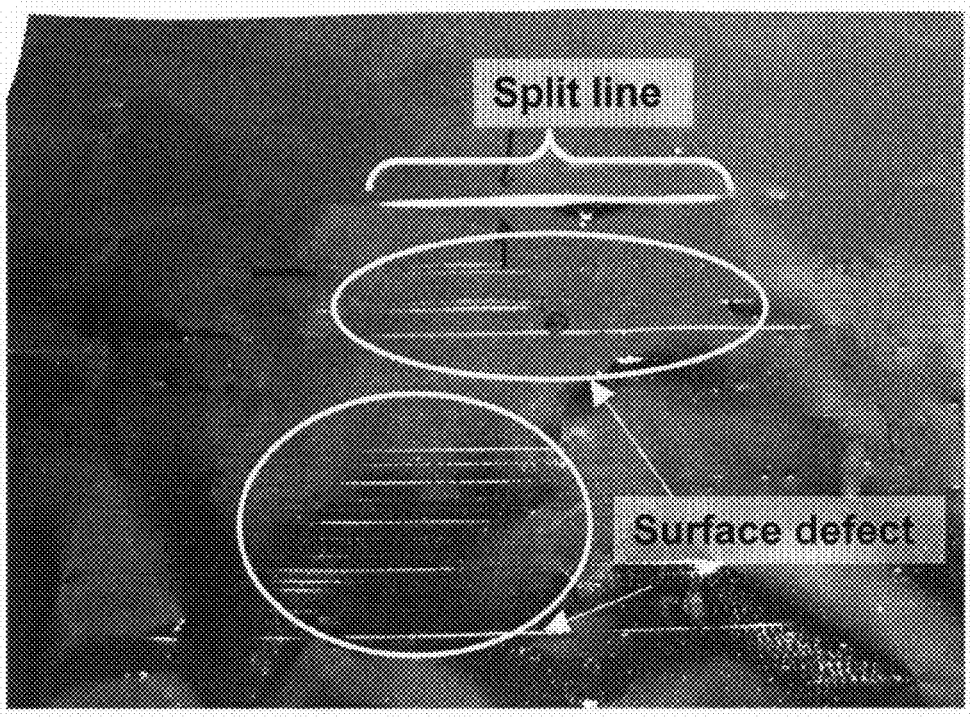
FIG. 1 is a picture showing examples of a split line and face lines formed along ribbon's length direction and on the surface of a ribbon.

An amorphous alloy ribbon can be prepared, as taught in U.S. Pat. No. 4,142,571, by having a molten alloy ejected through a slotted nozzle onto a rotating chill body surface. The ribbon surface facing the chill body surface looks dull but the opposite side surface facing atmosphere is shiny reflecting liquid nature of the molten alloy. In the following description, this side is also called "shiny side" of a cast ribbon. It was found that small amounts of molten alloy splash stick on the nozzle surface and were quickly solidified when the molten alloy surface tension was low, resulting in surface defects such as face lines, split lines and scratch-like lines formed along the ribbon length direction. Examples of split line and face lines are shown in FIG. 1. The face lines and scratch-like lines were formed on the ribbon surface facing the atmosphere side which was the opposite side of the ribbon surface facing the chill body surface. This in turn degraded the soft magnetic properties of the ribbon. More damaging was that the cast ribbon tended to split or break at the defect sites, resulting in termination of ribbon casting.

Further observation revealed the following: during casting, the number of the surface defects and their lengths and depths increased with casting time. This progression was found slower when defect lengths were between 5 mm and 200 mm, defect depths were less than 0.4Δt μm and the number of defects was less than 0.05×w along ribbon's length direction, where t and w were the thickness and width of a cast ribbon. Thus, ribbon breakage incidence was also low. On the other hand, when the number of defects along the ribbon length direction was more than 0.05×w, the defect size increased, resulting in ribbon breakage. This indicated that, for a continuous casting without ribbon breakage, it was necessary to minimize the incidence of molten alloy splash on the nozzle surface. After a number of experimental trials, the present inventors found that maintaining the molten alloy surface tension at a high level was crucial to reduce the molten alloy splash.

For example, the effect of molten alloy surface tension was compared between a molten alloy at a melting temperature of 1,350° C. with a chemical composition of $Fe_{81.4}Si_2B_{16}C_{0.6}$ having a surface tension of 1.0 N/m and a molten alloy at a melting temperature of 1,350° C. with a chemical composition of $Fe_{81.7}Si_4B_{14}C_{0.3}$ having a surface tension of 1.3 N/m. The molten alloy with $Fe_{81.4}Si_2B_{16}C_{0.6}$ showed more splash on the nozzle surface than $Fe_{81.7}Si_4B_{14}C_{0.3}$ alloy, resulting in shorter casting time. When the ribbon surface was examined, the ribbon based on $Fe_{81.4}Si_2B_{16}C_{0.6}$ alloy had more than several defects within 1.5 m of the ribbon. On the other hand, no such defects were observed on the ribbon based on the $Fe_{81.7}Si_4B_{14}C_{0.3}$ alloy. A number of other alloys were examined in light of the molten alloy surface tension effects, resulting in the finding that molten alloy splash was frequent and the number of defects within 1.5 m of ribbon length was more than 0.05×w when the molten alloy surface tension was below 1.1 N/m. It is noted that efforts to minimize solidified molten alloy splash on the nozzle surface by treating the nozzle surface by surface coating and polishing failed. The inventors then came up with a method of varying molten alloy surface tension at the interface between the molten alloy and the ribbon by controlling the oxygen concentration near the interface.

The next step the present inventors took was to find the chemical composition range in which the saturation induction of a cast amorphous ribbon exceeded 1.60 T which was one of the aspects of the present invention. It was found that the alloy compositions meeting this requirement were expressed by $Fe_aSi_bB_cC_d$ where $80.5 \le a \le 83$ at. %, $0.5 \le b \le 6$ at. %, $12 \le c \le 16.5$ at. %, $0.01 \le d \le 1$ at. % with a+b+c+d=100 and having incidental impurities commonly found in the commercial raw materials such as iron (Fe), ferrosilicon (Fe—Si) and ferroboron (Fe—B).

For Si and B contents, it was found that the following chemistry restriction was more favorable to achieve the objectives of increasing the molten alloy surface tension: $b \ge 166.5 \times (100-d)/100-2a$ and $c \le a-66.5 \times (100-d)/100$. In addition, for incidental impurities and intentionally added trace elements, the following elements with the given content ranges were found favorable: Mn at 0.05-0.30 wt. %, Cr at 0.01-0.2 wt. %, Cu at 0.005-0.20 wt. %.

Figure 2:
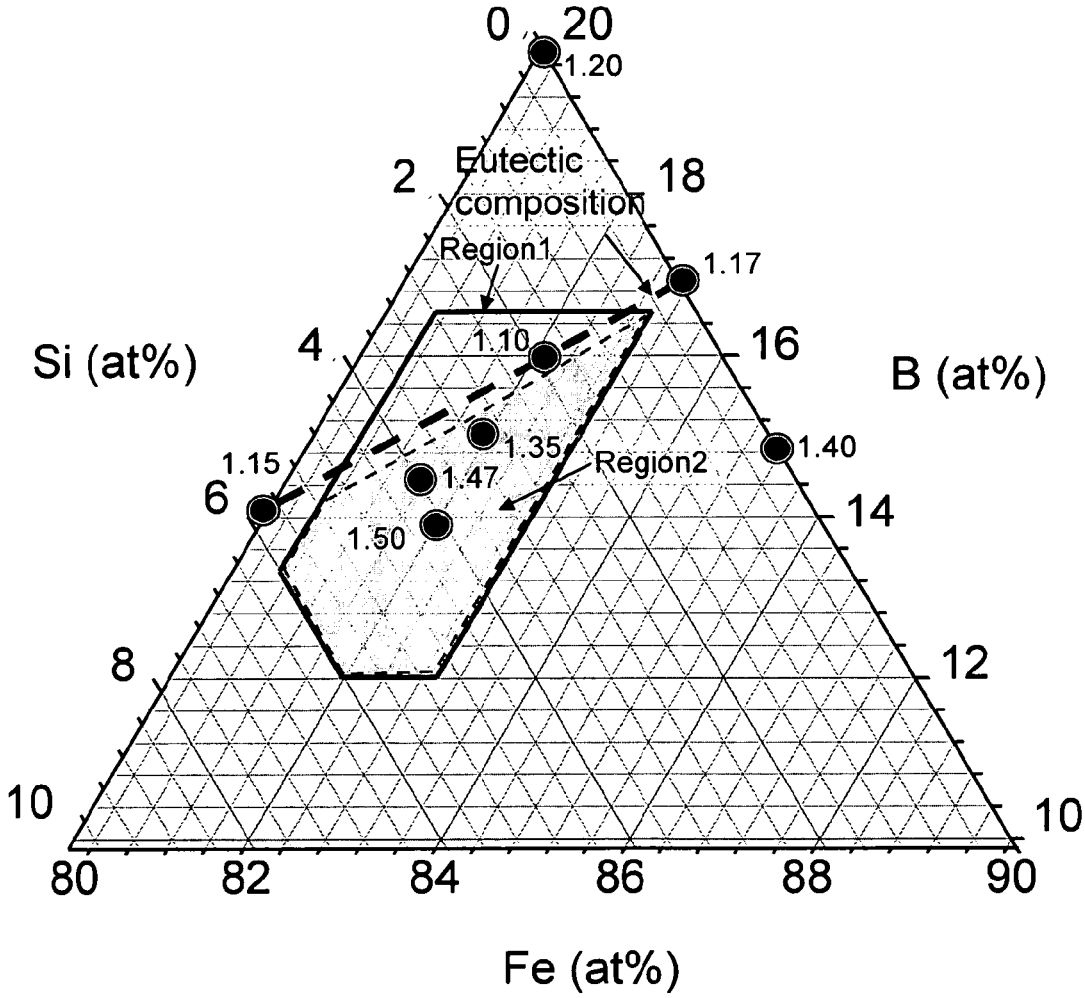
FIG. 2 is a diagram giving molten alloy surface tension on a Fe—Si—B phase diagram. The numbers shown are molten alloy surface tension in N/m.

Less than 20 at. % Fe was optionally replaced by Co and less than 10 at. % Fe was optionally replaced by Ni. The reasons for selecting the compositional ranges given in the two paragraphs above are the following: Fe content "a" of less than 80.5 at. % resulted in the saturation induction level of less than 1.60 T while "a" exceeding 83 at. % reduced alloy's thermal stability and ribbon formability. Replacing Fe by up to 20 at. % Co and/or up to 10 at. % Ni was favorable to achieve saturation induction exceeding 1.60 T. Si improved ribbon formability and enhances its thermal stability and exceeded 0.5 at. % and was less than 6 at. % to achieve envisaged saturation induction levels and high B—H squareness ratios. B contributed favorably to alloy's ribbon formability and its saturation induction level and exceeded 12 at. % and was less than 16.5 at. % as its favorable effects diminished above this concentration. These findings are summarized in the phase diagram of FIG. 2, in which Region 1 where molten alloy surface tension is at or more than 1.1 N/m and Region 2 where molten alloy surface tension exceeds 1.3 N/m which is more preferred are clearly indicated. In terms of chemical composition, Region 1 in FIG. 2 is defined by $Fe_aSi_bB_cC_d$ where $80.5 \le a \le 83$ at. %, $0.5 \le b \le 6$ at. %, $12 \le c \le 16.5$ at. %, $0.01 \le d \le 1$ at. % with a+b+c+d=100 and Region 2 is defined by $Fe_aSi_bB_cC_d$ where $80.5 \le a \le 83$ at. %, $0.5 \le b \le 6$ at. %, $12 \le c \le 16.5$ at. %, $0.01 \le d \le 1$ at. % with a+b+c+d=100 and $b \ge 166.5 \times (100-d)/100-2a$ and $c \le a-66.5 \times (100-d)/100$. In FIG. 2, eutectic compositions are represented by the heavy dashed line, showing that the molten alloy surface tension is low near the alloy system's eutectic compositions.

C was effective to achieve a high B—H squareness ratio and a high saturation induction above 0.01 at. % but molten alloy's surface tension was reduced above 1 at. % and less than 0.5 at. % C was preferred. Among incidental impurities and intentionally added trace elements, Mn reduced molten alloy's surface tension and allowable concentration limits was Mn<0.3 wt. More preferably, Mn<0.2 wt. %. Coexistence of Mn and C in Fe-based amorphous alloys improved alloys' thermal stability and (Mn+C)>0.05 wt. % was effective. Cr also improved thermal stability and was effective for Cr>0.01 wt. % but alloy's saturation induction decreased for Cr>0.2 wt. %. Cu is not soluble in Fe and tends to precipitate on ribbon surface and was helpful in increasing molten alloy's surface tension; Cu>0.005 wt. % was effective and Cu>0.02 wt. % was more favorable but C>0.2 wt. % resulted in brittle ribbon. It was found that 0.01-5.0 wt. % of one or more than one element from a group of Mo, Zr, Hf and Nb were allowable.

The alloy in accordance with embodiments of the present invention had a melting temperature preferably between 1,250° C. and 1,400° C. and in this temperature range, the molten alloy's surface tension was in the range of 1.1 N/m-1.6 N/m. Below 1,250° C., casting nozzles tended to plug frequently and above 1,400° C. molten alloy's surface tension decreased. More preferred melting points were 1,280° C.-1,360° C.

Figure 3:
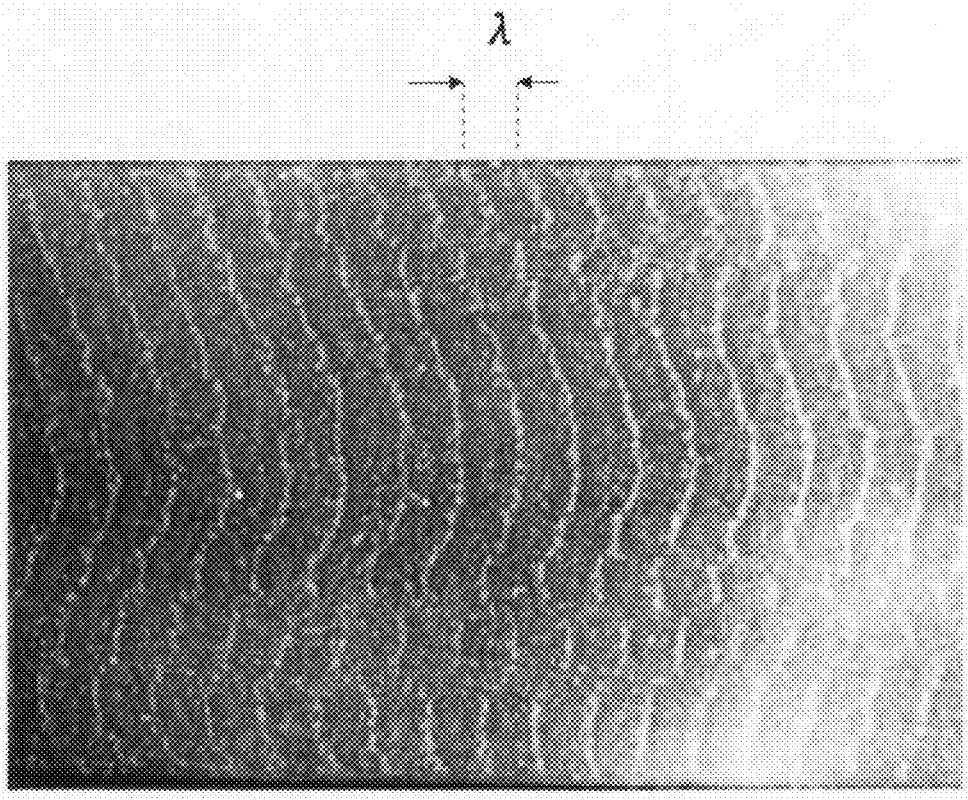
FIG. 3 is a picture illustrating a wavy pattern observed on a cast ribbon surface. The wave-length of wavy pattern on ribbon surface is indicated by the length λ.

The molten alloy surface tension a was determined by the following formula which was found in *Metallurgical and Materials Transactions*, vol. 37B, pp. 445-456 (published by Springer in 2006):

$$\sigma = U^2 G^3 \rho / 3.6\lambda^2$$

where U, G, ρ and λ are chill body surface velocity, gap between nozzle and chill body surface, mass density of alloy and wave length of wavy pattern observed on the shiny side of ribbon surface as indicated in FIG. 3, respectively. The measured wavelength, λ, was in the range of 0.5 mm-2.5 mm.

Figure 4:
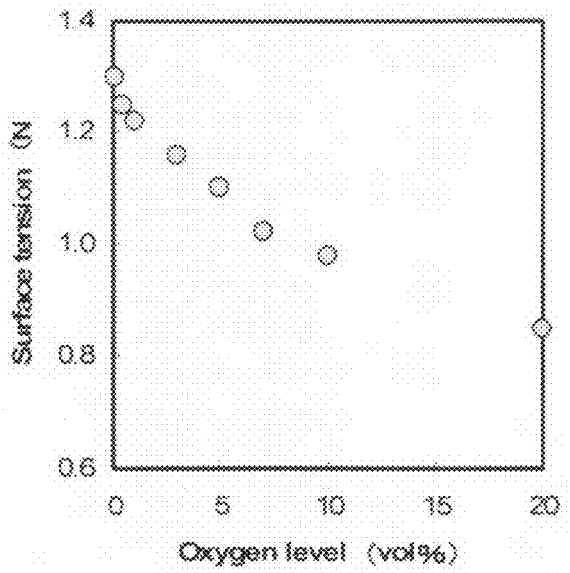
FIG. 4 is a graph showing molten alloy surface tension as a function of oxygen concentration in the vicinity of molten alloy-ribbon interface.

The inventors found that the surface defects could be further reduced by providing oxygen gas with a concentration of up to 5 vol. % at the interface between molten alloy and cast ribbon right below the casting nozzle. The upper limit for $O_2$ gas was determined based on the data of molten alloy surface tension versus $O_2$ concentration shown in FIG. 4 which indicates that molten alloy surface tension becomes less than 1.1 N/m for the oxygen gas concentration exceeding 5 vol. %.

The inventors further found that the ribbon thickness from 10 μm to 50 μm was obtained according to embodiments of the invention in the ribbon fabrication method. It was difficult to form a ribbon for thickness below 10 μm and above ribbon thickness of 50 μm ribbon's magnetic properties deteriorated.

The ribbon fabrication methods, according to embodiments of the invention, were applicable to wider amorphous alloy ribbons as Example 4 indicated.

To the surprise of the inventors, a ferromagnetic amorphous alloy ribbon showed a low magnetic core loss, contrary to the expectation that core loss generally increased when core material's saturation induction increased. For example, an annealed straight strip of a ferromagnetic amorphous alloy ribbon, according to embodiments of the present invention, exhibited a magnetic core loss of less than 0.14 W/kg when measured at 60 Hz and at 1.3 T induction.

Example 1

Ingots with chemical compositions, in accordance with embodiments of the present invention were prepared and were cast from molten metals at 1,350° C. on a rotating chill body. The cast ribbons had a width of 100 mm and its thickness was in 22-24 μm range. A chemical analysis showed that the ribbons contained 0.10 wt. % Mn, 0.03 wt. % Cu and 0.05 wt. % Cr. A mixture of $CO_2$ gas and oxygen was blown into near the interface between molten alloy and the cast ribbon. The oxygen concentration near the interface between molten alloy and the cast ribbon was 3 vol %. The molten alloy surface tension, σ, was determined by measuring the wave length of the wavy pattern on the shiny side of the cast ribbon using the formula $\sigma=U^2 G^3 \rho/3.6\lambda^2$. Ribbon surface defect number within 1.5 m along ribbon's length direction was measured 30 minutes after cast start-up and the maximum number of surface defects, N, from three samples is given in Table 1. Single strips cut from the ribbons were annealed at 300° C.-400° C. with a magnetic field of 1500 A/m applied along ribbon strips' length direction and the magnetic properties of the heat-treated strips were measured according to ASTM Standards A-932. The results obtained are listed in Table 1. The samples Nos. 1-15 met the requirements of the invention objectives for molten alloy surface tension σ, number of defects per 1.5 m of the cast ribbon, N, saturation induction, $B_s$, and magnetic core loss $W_{1.3/60}$ at 60 Hz excitation at 1.3 T induction. Since the ribbon width was 100 mm, the maximum number for N was 5. Table 2 gives examples of failed ribbons, samples Nos. 1-6. For example, samples Nos. 1, 3 and 4 showed favorable magnetic properties but a number of ribbon surface defects resulted due to the molten alloy surface tension being lower than 1.1 N/m. The molten alloy surface tensions for samples Nos. 2, 5 and 6 were higher than 1.1 N/m resulting in N=0 but $B_s$ was lower than 1.60 T.

TABLE 1

| Sample | Composition (at %) | | | | | | σ | | $B_s$ | $W_{1.3/60}$ |
|---|---|---|---|---|---|---|---|---|---|---|
| No. | Fe | Co | Ni | Si | B | C | (N/m) | N | (T) | (W/kg) |
| 1 | 81.7 | 0 | 0 | 3 | 15 | 0.3 | 1.16 | 2 | 1.63 | 0.094 |
| 2 | 81.7 | 0 | 0 | 4 | 14 | 0.3 | 1.31 | 0 | 1.63 | 0.093 |
| 3 | 81.0 | 0 | 0 | 6 | 12 | 1 | 1.48 | 0 | 1.61 | 0.101 |
| 4 | 80.5 | 0 | 0 | 5 | 14.2 | 0.3 | 1.13 | 2 | 1.62 | 0.103 |
| 5 | 81.7 | 0 | 0 | 4.5 | 13.5 | 0.3 | 1.38 | 0 | 1.62 | 0.094 |
| 6 | 83.0 | 0 | 0 | 0.5 | 16.5 | 0.01 | 1.22 | 0 | 1.62 | 0.135 |
| 7 | 81.7 | 0 | 0 | 5 | 13 | 0.3 | 1.43 | 0 | 1.62 | 0.095 |
| 8 | 81.7 | 0 | 0 | 2.3 | 16 | 0.01 | 1.11 | 4 | 1.64 | 0.095 |
| 9 | 80.5 | 0 | 0 | 6 | 13.2 | 0.3 | 1.55 | 0 | 1.60 | 0.099 |
| 10 | 80.5 | 0 | 0 | 2.7 | 16.5 | 0.3 | 1.18 | 2 | 1.62 | 0.105 |
| 11 | 83.0 | 0 | 0 | 4.7 | 12 | 0.3 | 1.58 | 0 | 1.62 | 0.109 |
| 12 | 76.7 | 5 | 0 | 4 | 14 | 0.3 | 1.34 | 0 | 1.70 | 0.104 |
| 13 | 61.7 | 20 | 0 | 4 | 14 | 0.3 | 1.36 | 0 | 1.78 | 0.101 |
| 14 | 79.7 | 0 | 2 | 4 | 14 | 0.3 | 1.27 | 0 | 1.65 | 0.100 |
| 15 | 71.7 | 0 | 10 | 4 | 14 | 0.3 | 1.25 | 0 | 1.60 | 0.103 |

TABLE 2

| Ref. sample | Composition (at %) | | | | σ | | $B_s$ | $W_{1.3/60}$ |
|---|---|---|---|---|---|---|---|---|
| No. | Fe | Si | B | C | (N/m) | N | (T) | (W/kg) |
| 1 | 81.4 | 2 | 16 | 0.6 | 0.95 | 6 | 1.64 | 0.091 |
| 2 | 79.7 | 8 | 12 | 0.3 | 1.45 | 0 | 1.57 | 0.095 |
| 3 | 81 | 3 | 14.8 | 1.2 | 1.05 | 12 | 1.63 | 0.103 |
| 4 | 80.5 | 4 | 14.9 | 0.6 | 0.90 | 12 | 1.62 | 0.096 |
| 5 | 83.7 | 2 | 14 | 0.3 | 1.58 | 0 | 1.58 | 0.124 |
| 6 | 81.7 | 8 | 10 | 0.3 | 1.68 | 0 | 1.59 | 0.120 |

Example 2

An amorphous alloy ribbon having a composition of $Fe_{81.7}Si_3B_{15}C_{0.3}$ was cast under the same casting condition as in Example 1 except that $O_2$ gas concentration was changed from 0.1 vol. % to 20 vol. % (equivalent to air). The magnetic properties, $B_s$ and $W_{1.3/60}$ and molten alloy surface tension σ and maximum number of surface defects, N, obtained are listed in Table 3. The data demonstrate that oxygen level exceeding 5 vol. % reduces molten alloy surface tension, which in turn increases the defect number leading to shorter cast time.

TABLE 3

| | Oxygen level (%) | σ (N/m) | N | $B_s$ (T) | $W_{1.3/60}$ (W/kg) |
|---|---|---|---|---|---|
| Sample No. | | | | | |
| 16 | 5 | 1.10 | 4 | 1.60 | 0.095 |
| 1 | 3 | 1.16 | 2 | 1.63 | 0.094 |
| 17 | 1 | 1.22 | 0 | 1.63 | 0.094 |
| 18 | 0.5 | 1.25 | 0 | 1.63 | 0.093 |
| Ref. sample No. | | | | | |
| 7 | 20 (Air) | 0.85 | 8 | 1.63 | 0.140 |
| 8 | 10 | 0.98 | 6 | 1.63 | 0.100 |
| 9 | 7 | 1.02 | 6 | 1.63 | 0.096 |

Example 3

Small amount of Cu was added to the alloy of Example 2 and the ingots were cast into amorphous alloy ribbons as in Example 1. The magnetic properties, $B_s$ and $W_{1.3/60}$ and molten alloy surface tension and the maximum defect number on the ribbons are compared in Table 4. The ribbon with 0.25 wt. % Cu showed favorable magnetic properties but was brittle. No increase in the molten alloy surface tension was observed in the ribbon with 0.001 wt. % Cu.

TABLE 4

| Sample No. | Cu Wt. % | σ (N/m) | N | $B_s$ (T) | $W_{1.3/60}$ (W/kg) |
|---|---|---|---|---|---|
| 1 | 0.03 | 1.16 | 2 | 1.63 | 0.094 |
| 19 | 0.20 | 1.25 | 0 | 1.63 | 0.093 |
| 20 | 0.005 | 1.11 | 4 | 1.63 | 0.106 |
| Ref. sample No. | Cu wt. % | σ (N/m) | N | $B_s$ (T) | W13/60 (W/kg) |
| 10 | 0.001 | 1.05 | 6 | 1.62 | 0.091 |
| 11 | 0.25 | 1.28 | 0 | 1.60 | 0.108 |

Example 4

An amorphous alloy ribbon having a composition of $Fe_{81.7}Si_3B_{15}C_{0.3}$ was cast under the same condition as in Example 1, except that ribbon width was changed from 140 mm to 254 mm and the ribbon thickness was changed from 15 μm to 40 μm. The magnetic properties, $B_s$, $W_{1.3/60}$ and molten alloy surface tension σ and number of surface defects, N, obtained are listed in Table 5.

TABLE 5

| Sample No. | Thickness (μm) | Width (mm) | σ (N/m) | N | $B_s$ (T) | $W_{13/60}$ (W/kg) |
|---|---|---|---|---|---|---|
| 21 | 25 | 140 | 1.16 | 3 | 1.63 | 0.098 |
| 22 | 25 | 170 | 1.16 | 3 | 1.63 | 0.100 |
| 23 | 25 | 210 | 1.16 | 4 | 1.63 | 0.101 |
| 24 | 25 | 254 | 1.16 | 5 | 1.63 | 0.105 |
| 25 | 15 | 170 | 1.16 | 3 | 1.63 | 0.105 |
| 26 | 22 | 170 | 1.16 | 3 | 1.63 | 0.101 |
| 27 | 30 | 170 | 1.16 | 5 | 1.63 | 0.106 |
| 28 | 40 | 170 | 1.16 | 5 | 1.63 | 0.114 |

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A ferromagnetic amorphous alloy ribbon produced by a continuous casting, the ribbon comprising:

an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities, the ribbon having been cast from a molten state of the alloy, with a molten alloy surface tension of greater than or equal to 1.1 N/m, the ribbon having a ribbon length, a ribbon thickness, a ribbon width, and a ribbon surface facing a casting atmosphere side, the ribbon having a defect occurrence frequency greater than zero and less than 0.05×w times per 1.5 m of the ribbon length, where w is the ribbon width in mm, wherein upon a defect occurring, the defect is on the ribbon surface facing the casting atmosphere side and is measured in terms of a defect length, a defect depth, and a defect occurrence frequency, and wherein the defect length along a direction of the ribbon's length is between 5 mm and 200 mm, the defect depth being at less than 0.4×t μm, where t is the ribbon thickness in μm, and wherein when the ribbon has been annealed and is in a straight strip form, the ribbon has a saturation magnetic induction exceeding 1.60 T and exhibits a magnetic core loss of less than 0.14 W/kg when measured at 60 Hz and at a 1.3 T induction level.

2. The ferromagnetic amorphous alloy ribbon of claim 1, wherein the Si content b and the B content c are related to the Fe content a and the C content d according to relations of b≤166.5×(100−d)/100−2a and c≤a−66.5×(100−d)/100.

3. The ferromagnetic amorphous alloy ribbon of claim 1, further comprising a trace element including both incidental and intentionally added impurities selected from at least a member of the group consisting of Cu, Mn and Cr.

4. The ferromagnetic amorphous alloy ribbon of claim 3, wherein the Cu content is between 0.005 and 0.20 wt. %.

5. The ferromagnetic amorphous alloy ribbon of claim 3, wherein the Mn content is between 0.05 and 0.30 wt. %, and the Cr content is between 0.01 and 0.2 wt. %.

6. The ferromagnetic amorphous alloy ribbon of claim 1, wherein up to 20 at. % of Fe is optionally replaced by Co, and up to 10 at. % Fe is optionally replaced by Ni.

7. The ferromagnetic amorphous alloy ribbon of claim 1, wherein the ribbon has been cast from a molten state of the alloy at temperatures between 1,250 ° C. and 1,400 ° C.

8. The ferromagnetic amorphous alloy ribbon of claim 1, wherein the ribbon has been cast in an environmental atmosphere containing less than 5 vol. % oxygen gas at the molten alloy-ribbon interface.

9. The ferromagnetic amorphous alloy ribbon of claim 1, wherein the ribbon comprises a portion 100 mm in width and 1.5 m in length, the portion having a defect occurrence count of less than 5.

10. An energy efficient device, comprising:

a ferromagnetic amorphous alloy ribbon produced from a continuous casting, the ribbon being an alloy having a composition represented by $Fe_aSi_bB_cC_d$ where 80.5≤a≤83 at. %, 0.5≤b 6≤at. %, 12≤c≤16.5 at. %, 0.01≤d≤1 at. % with a +b+c+d=100 and incidental impurities, the ribbon having been cast from a molten state of the alloy, with a molten alloy surface tension of greater than or equal to 1.1 N/m, the ribbon having a ribbon length, a ribbon thickness, a ribbon width, and a ribbon surface facing a casting atmosphere side, the ribbon having a defect occurrence frequency being less than 0.05×w times per 1.5 m of the ribbon length, where w is the ribbon width in mm, wherein upon a defect occurring, the defect is on the ribbon surface facing the casting atmosphere side, and is measured in terms of a defect length, a defect depth, and a defect occurrence frequency, the defect length along a direction of the ribbon's length is between 5 mm and 200 mm, the defect depth being at less than 0.4 ×t μm, where t is the ribbon thickness in μm, wherein when the ribbon has been annealed and is in a straight strip form, the ribbon has a saturation magnetic induction exceeding 1.60 T and exhibiting a magnetic core loss of less than 0.14 W/kg when measured at 60 Hz and at a 1.3 T induction level, and the energy efficient device being a member selected from the group consisting of a transformer, a rotational machine, an electric choke, a magnetic sensor and a pulse power device.

11. A method of fabricating an energy efficient device, the method comprising:

selecting an alloy having a composition represented by $Fe_aSi_bB_cC_d$, where 80.5≤a≤83 at. %, 0.5≤b≤6 at .%, 12≤c≤16.5 at. %, 0.01≤d≤1 at. % with a +b+c+d=100 and incidental impurities;

continuous casting from a molten state of the alloy in an environmental atmosphere containing less than 5 vol. % oxygen gas at the molten alloy-ribbon interface, the continuous casting being performed such that the alloy in a molten state during the continuous casting has a surface tension exceeding and including 1.1 N/m;

obtaining a ribbon from the cast alloy having a ribbon length, a ribbon thickness, a ribbon width, and a ribbon surface facing a casting atmosphere side, wherein the ribbon has a defect occurrence frequency greater than zero and less than 0.05×w times per 1.5 m of the ribbon length, where w is the ribbon width in mm, wherein upon a defect occurring, the defect is controlled during formation by controlling a surface tension of the alloy in a molten state during the casting, is on the ribbon surface facing the casting atmosphere side, and is measured in terms of a defect length, a defect depth, and a defect occurrence frequency, the defect length along a direction of the ribbon's length is between 5 mm and 200 mm, the defect depth being at less than 0.4×t μm, where t is the ribbon thickness in μm, and wherein when the ribbon has been annealed and is in a straight strip form, the ribbon has a saturation magnetic induction exceeding 1.60 T and exhibits a magnetic core loss of less than 0.14 W/kg when measured at 60 Hz and at a 1.3 T induction level; and incorporating the ribbon as part of an energy efficient device, the energy efficient device being a member selected from the group consisting of a transformer, a rotational machine, an electric choke, a magnetic sensor and a pulse power device.

12. A method of fabricating a ferromagnetic amorphous alloy ribbon, the method comprising:

continuous casting from a molten state of an alloy, having a composition represented by $Fe_aSi_bB_cC_d$, where $80.5 \leq a \leq 83$ at. %, $0.5 \leq b \leq 6$ at. %, $12 \leq c \leq 16.5$ at. %, $0.01 \leq d \leq 1$ at. % with a $+b+c+d=100$ and incidental impurities, to obtain a ferromagnetic amorphous alloy ribbon, and controlling a surface tension of the alloy in the molten state during the continuous casting to at least 1.1 N/m to control formation of defects on the ribbon, wherein the ribbon has a defect occurrence frequency greater than zero and less than $0.05 \times w$ times per 1.5 m of the ribbon length, where w is the ribbon width in mm, wherein upon a defect occurring, the defect is controlled during formation by controlling the surface tension of the alloy in the molten state during the casting, is on the ribbon surface facing the casting atmosphere side, and is measured in terms of a defect length, a defect depth, and a defect occurrence frequency, the defect length along a direction of the ribbon's length is between 5 mm and 200 mm, the defect depth being at less than $0.4 \times t$ μm, where t is the ribbon thickness in μm, and when the ribbon has been annealed and is in a straight strip form, the ribbon has a saturation magnetic induction exceeding 1.60 T and exhibiting a magnetic core loss of less than 0.14 W/kg when measured at 60 Hz and at a 1.3 T induction level.

13. The method of claim 12, wherein the surface tension is controlled by controlling an oxygen content of an environmental atmosphere at the molten alloy-ribbon interface during the continuous casting.

14. The method of claim 13, wherein the environmental atmosphere is controlled to less than 5 vol. % oxygen gas at the molten alloy-ribbon interface.

15. The method of claim 14, wherein the ribbon obtained is at least 100 mm in width and 1.5 m in length.

16. The method of claim 12, wherein the Si content b and the B content c are related to the Fe content a and the C content d according to relations of $b \leq 166.5 \times (100-d)/100-2a$ and $c \leq 66.5 \times (100-d)/100$.

17. The method of claim 12, wherein the alloy further comprises a trace element including both incidental and intentionally added impurities selected from at least a member of the group consisting of Cu, Mn and Cr.

18. The method of claim 12, wherein the Cu content is between 0.005 and 0.20 wt. %.

19. The method of claim 12, wherein the Mn content is between 0.05and 0.30 wt. %, and the Cr content is between 0.01 and 0.2 wt. %.

20. The method of claim 12, wherein up to 20 at. % of Fe is optionally replaced by Co, and up to 10 at. % Fe is optionally replaced by Ni.

21. The method of claim 12, wherein casting is carried out when the molten state of the alloy is at temperatures between 1,250 ° C. and 1,400 ° C.

* * * * *

UNITED STATES PATENT AND TRADEMARK OFFICE

CERTIFICATE OF CORRECTION

PATENT NO. : 8,974,609 B2
APPLICATION NO. : 12/923074
DATED : March 10, 2015
INVENTOR(S) : Yuichi Ogawa et al.

It is certified that error appears in the above-identified patent and that said Letters Patent is hereby corrected as shown below:

In the Claims

Column 9, Line 38, (claim 2) delete "b≤" and insert -- b≥ --, therefor.

Column 10, Line 13, (claim 10) delete "0.5≤b 6≤at.%," and insert -- 0.5≤b≤6 at.%, --, therefor.

Column 10, Line 14, (claim 10) delete "a +b+c+d=100" and insert -- a+b+c+d=100 --, therefor.

Column 10, Line 43, (claim 11) delete "at .%," and insert -- at. %, --, therefor.

Column 10, Line 44, (claim 11) delete "a +b+c+d=100" and insert -- a+b+c+d=100 --, therefor.

Column 11, Line 16, (claim 11) delete "a +b+c+d=100" and insert -- a+b+c+d=100 --, therefor.

Column 11, Line 33, (claim 12) delete "0.4×tμm," and insert -- 0.4×t μm, --, therefor.

Column 12, Line 17, (claim 16) delete "b≤" and insert -- b≥ --, therefor.

Column 12, Line 18, (claim 16) delete "c≤66.5×(100-d)/100." and insert -- c≤a-66.5×(100-d)/100. --, therefor.

Column 12, Line 26, (claim 19) delete "0.05and" and insert -- 0.05 and --, therefor.

Signed and Sealed this
Fourth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,974,609 B2
APPLICATION NO. : 12/923074
DATED : March 10, 2015
INVENTOR(S) : Yuichi Ogawa et al.

It is certified that error appears in the above-identified patent and that said Letters Patent is hereby corrected as shown below:

In the Claims

Column 9, Line 52, (claim 2) delete "b≤" and insert --b≥--, therefor.

Signed and Sealed this
Twenty-fifth Day of August, 2015

Michelle K. Lee

Michelle K. Lee
*Director of the United States Patent and Trademark Office*